US005992293A

United States Patent [19]

Josdal

[11] Patent Number: 5,992,293

[45] **Date of Patent: *Nov. 30, 1999**

[54] CYLINDER DEVICE

[75] Inventor: Torbjörn Inge Josdal, Muskö , Sweden

[73] Assignee: AB Rexroth Mecman, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,780

[22] Filed: Jan. 30, 1997

[30] Foreign Application Priority Data

Feb. 13, 1996 [SE] Sweden ..... 9600522

[51] Int. Cl.[6] ..... F15B 15/22

[52] U.S. Cl. ..... 91/26; 91/27; 91/31; 91/408; 251/216

[58] Field of Search ..... 91/26, 397, 405, 91/407, 27, 31, 408; 251/216, 121

[56] References Cited

U.S. PATENT DOCUMENTS

| | | | |
|---|---|---|---|
| 261,671 | 7/1882 | Carney | 251/216 |
| 876,285 | 1/1908 | Ullmann | 251/216 |
| 1,971,048 | 8/1934 | Parsons | 91/407 |
| 3,056,385 | 10/1962 | Topinka et al. | 91/26 |
| 3,474,826 | 10/1969 | Breitsprecher et al. | 91/31 |
| 3,559,531 | 2/1971 | Leibfritz et al. | 91/26 |
| 5,193,433 | 3/1993 | Reimer | 91/27 |

FOREIGN PATENT DOCUMENTS

| | | | |
|---|---|---|---|
| 7540 | 4/1928 | Australia | 91/26 |
| 2 166 024 | 8/1973 | France . | |
| 27 25 791 | 12/1978 | Germany . | |
| 565 950 | 8/1975 | Switzerland . | |
| 1109088 | 4/1968 | United Kingdom | 91/26 |

*Primary Examiner*—F. Daniel Lopez
*Attorney, Agent, or Firm*—Townsend and Townsend and Crew LLP

[57] ABSTRACT

The invention concerns a device in an piston cylinder aggregate including a valve element (8) which comprises a valve body (9) for choking the flow in a fluid channel (6) in co-operation with a valve opening (7), wherein the device is arranged in a bore (11) in an end wall (1) of the piston cylinder aggregate and wherein the valve element (8) is provided with a setting means (10) to allow adjustment from the outside of the end wall. The invention is distinguished by that the valve body (8) is provided with a screw thread along its axial extension, that the valve opening (7) is debauching in a portion (12) of said bore which at least partly is provided with a screw thread corresponding to the one on the valve body, that the setting means (10) is extending outside the end wall surface, and that a ring shaped sealing means (14) is arranged in said hole (11) in direct proximity to the outside of the end wall (1) and having its outside surface substantially in level with the surrounding surface of the end wall, said sealing ring exerting a sealing cooperation with the setting means (10).

9 Claims, 1 Drawing Sheet

CYLINDER DEVICE

BACKGROUND OF THE INVENTION

This invention concerns a device in a piston cylinder aggregate including a valve element which comprises a valve body for choking the flow in a fluid channel in cooperation with a valve opening. It also concerns a piston cylinder aggregate including at least one such device.

Such devices are previously known, for example from U.S. Pat. No. 2,719,510, wherein the valve element includes a setting means with a conical valve and a co-operating seat. The setting means is disposed radially in the cylinder end wall and because of its substantial axial extension it demands great constructional height and thus large dimensions of the end wall. In many applications the described setting means further leads to an essential problem related to accumulation of dirt in the irregular surfaces.

In another previously known solution the setting means, in general according to U.S. Pat. No. 2,719,510, is applied at an angle with respect to the outside surface of the cylinder end wall so as to be disposed non-radially in the cylinder end wall. Also this solution, however, result in non desired dirt collecting irregularities because a deep pocket is formed at the outer end of the setting means.

Irregularities and pockets of this kind are considered to be problematic in applications where there are rigorous demands for cleanliness, e.g. in the food industry. In such applications dirt collecting irregularities lead to a serious hygienic problem.

SUMMARY OF THE INVENTION

It is an aim with this invention to provide a solution to the above problems and to obtain a device of the kind defined in the introduction which allows essential reduction of dirt collecting irregularities, pockets and the like and at the same time result in a device having radically reduced constructional height.

This aim is obtained in a device according to the above by the valve body being provided with a screw thread along its axial extension, the valve opening debouching in a portion of said bore which at least partly is provided with a screw thread corresponding to the one on the valve body. The setting means extends outside the end wall surface. A ring shaped sealing means is arranged in said bore in direct proximity to the outside of the end wall and has its outside surface substantially in level with he surrounding surface of the end wall. Said sealing ring exerts a sealing cooperation with the setting mean. The valve opening being located such with respect to the valve body that a choking cooperation occurs at the end of the valve body which is directed against the outside of the end wall.

By the valve body being threaded along its axial extension and thereby the setting function being integrated therewith, a short valve element and thereby reduced constructional height of the device is obtained so that it may be applied also in piston cylinder aggregates having relatively limited dimensions, as well as at a location having limited space in a cylinder end wall. The sealing means which provides a pressure seal between the material of the end wall and the setting means prevents the flow in the flow channel to reach the surroundings and instead safely to be conducted to a desired discharge or the like. Also in case the throttling is at the lower side of the valve body a certain flow will occur above the valve body because of leakage upwards through the thread to the outside of the valve body, the flow will be prevented from reaching to the outside by the sealing means. The arrangement of the sealing ring in the direct proximity to the outside of the end wall and having its outer surface essentially in level with the surrounding surface of the end wall ensures reduction to a minimum of the presence and extent of dirt collecting pockets or the like.

In particular, limited constructional height is required through the feature that the choking action is undertaken on the outermost end of the valve body. The total height of the device according to this aspect only has to be the total of the heights of the sealing means and the valve body and the travel length thereof which gives great opportunities to use the device in applications where the space is very limited.

The feature that the portion of the bore comprising the screw threaded portion also is provided with an axially extending radial enlargement at a distance from the valve opening, said enlargement comprising a bypass channel past the valve body and thereby the forward leading channel. This results in a well adapted further guidance of the choked flow.

The feature wherein the sealing means is arranged to cooperate with the setting means on the one hand through an element, which seals against flow in the flow channel and through an element comprising an outward sealing and wiping means ensures well adapted combined sealing and wiping function and the feature wherein the sealing means comprises means for preventing the valve element from being screwed out from the bore gives safe function as well as simplicity with respect to assembly.

The invention also concerns a piston cylinder aggregate including at least one such valve arrangement, wherein the aggregate is particularly useful in applications with high demand for cleanliness.

Further advantages will be clear from the following detailed description.

BRIEF DESCRIPTION OF THE DRAWINGS

The invention will now be described closer by way of an embodiment and at the background of the annexed drawing, wherein.

DESCRIPTION OF THE PREFERRED EMBODIMENTS

Figure 1:
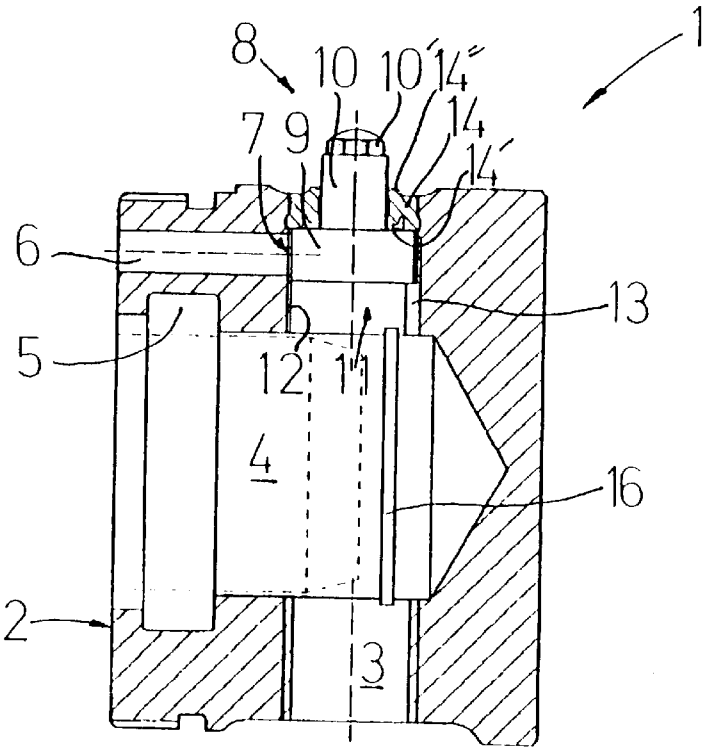
FIG. 1 shows a cylinder end wall including a device according to the invention in an axial section and having the valve element in a first position.

The cylinder end wall 1 of FIG. 1 is in principle conventionally constructed and forms together with a not shown second cylinder end wall and a not shown cylinder tube, a fluid (here, but not limiting a pneumatic) cylinder for receiving a movable piston inside the cylinder and a piston rod which is connected to the piston. Reference numeral 2 indicates the side of the cylinder end wall 1 which is turned against the inside of the cylinder.

Further, the cylinder end wall 1 is provided with an inlet-outlet port 3 and a space 4 for receiving a cushioning extension which is connected to a piston and which is indicated with interrupted lines in the Figures, said space at 5 being provided with a seat for a cushioning seal. An end position cushioning channel 6 extends axially and outside said space 4 and ends in a radial bore 11, whereby the mouth of channel 6 in this bore forms a valve opening at 7. The bore 11 is provided with a threaded portion 12 where the valve opening debouches and where a valve element is screwed in by means of a correspondingly threaded valve body 9. This valve body 9 co-operates with the valve opening 7 in order to obtain adjustable throttling of fluid flowing in the end position cushioning channel 6. The valve element 8 further comprises a setting means 10 having reduced diameter with respect to the valve body 9, said means 10 in use extending outside the surface of the cylinder end wall such that a wrench grip 10' is accessible for axial adjustment of the valve element by screwing.

Downstream the valve opening 7 the choked flow passes through a by-pass channel 13, which consists of an axially disposed radial enlargement of the bore 11. After passage past the valve body 9 the choked flow is lead further out through the port 3.

A ring shaped sealing means 14 is arranged outermost in the hole 11 in the direct proximity to the outside of the cylinder end wall and in such a way that its outside surface is essentially in level with the surface of the cylinder end wall, whereby a seal is ensured between this sealing ring 14 and the setting means through the sealing lip 14' against the choked flow and possible inside pressure. Further, by the outward sealing and wiping lip 14" it is ensured that formation of dirt collecting pockets and other irregularities are reduced as much as possible.

The sealing means 14 is preferably also constructed and has such dimensions that it is provided with an inward stop surface 15 which prevents threading out of the valve element 8 from the bore 11. As is clear from the Figure and as is preferred, the sealing ring 14 is placed in a seat which comprises a groove 15' for receiving a corresponding radial enlargement at the inner part of the peripheral surface of the sealing ring 14. The groove 15' and the enlargement is preferably shallow so as to facilitate assembly. Further a locking effect will occur of the sealing ring 14 in the end wall because of the inward co-operation of the ring with the setting means 10, which effectively ensures that the sealing means 14 remains in its seat and is not deformed so that it falls out from the seat.

For preventing the valve element 9 to be screwed down into the receiving space 4 when the device is arranged as is shown in the Figure in an end position cushioning channel, the space 4 is preferably provided with a ring shaped groove 16 for receiving a conventional locking ring or the like which in this case thus only serves to limit the radial inward movement of the valve element 8.

Figure 2:
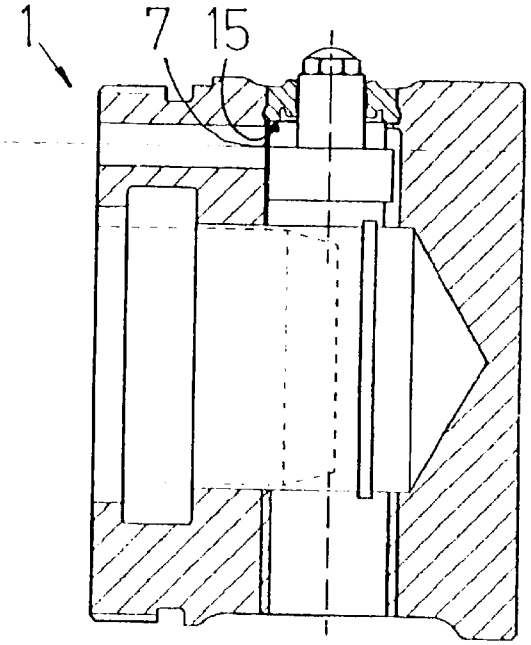
FIG. 2 shows the cylinder end wall according to FIG. 1 having the valve element in a section position.

FIG. 2 shows the end wall 1 but with the valve element 8 screwed down from the closing position in FIG. 1 into a position where the valve opening 7 is opened.

The invention may be modified within the scope of the following claims. It may thus according to requirements be used in any flow channel in a piston cylinder aggregate, thus also in a speed adjustment channel, that is for choking the outlet fluid from the cylinder.

Also other embodiments of the different parts of the device may come into question. As an example a solution is contemplated where the choked flow after passage through the valve opening 7 is lead forward in another way than through a by-pass channel of the kind shown in FIG. 1. Also other forward leading channels are possible, for example one which is substantially an extension of the shown channel 6. It is also possible to arrange a channel axially through the inner portion of the valve body 9 and with openings on its lower side (on the Figures) as well as at the lower part of the means 10. Such a channel would eliminate the need for a particular forward leading channel. Also if the inner end of the valve body is arranged to co-operate with the valve opening there is no need of any particular by-pass channel.

Although it is preferred that the ring shaped sealing means integrate the three functions: sealing inwards, sealing/wiping outwards and stop for the valve element, this is not necessary for the invention. Instead it is within the scope of the invention that these functions may be performed by separate elements.

The setting means 10 is at least partially circular cylindric and has preferably a reduced diameter with respect to a valve body 9. Because of its sealing co-operation with the sealing means 14, there are conventional demands with respect to surface smoothness on its envelope surface. A solution where the parts of the valve element 8 have substantially the same diameter is not excluded. In that case the channels leading past and forward are preferably arranged otherwise than what is shown in the Figures. The choking function between the upper end on the valve body and the valve opening can in that case be obtained by the valve body being limited upwards by a ring-shaped groove and/or a series of openings.

The setting of the means 10 may be accomplished through other conventional means besides a wrench grip 10' bearing in mind what is acceptable at the present application.

I claim:

1. Device in a piston cylinder aggregate including a valve element (8) which comprises a valve body (9) for choking the flow in a fluid channel (6) in cooperation with a valve opening (7), wherein the device is arranged in a bore (11) in an end wall (1) of the piston cylinder aggregate and wherein the valve element (8) is provided with a setting means (10) to allow adjustment from the outside of the end wall, wherein:

the valve body (8) is provided with screw thread along its axial extension, the valve opening (7) is debouching in a portion (12) of said bore which at least partly is provided with a screw thread corresponding to the one on the valve body, the setting means (10) is extending outside the end wall surface, a ring shaped sealing means (14) is arranged in said bore (11) in direct proximity to the outside of the end wall (1) and having its outside surface substantially in level with the surrounding surface of the end wall, said sealing ring exerting a sealing cooperation with the setting means (10), the valve opening (7) is located such with respect to the valve body (9) that the choking cooperation occurs at the end of the valve body which is directed against the outside of the end wall, a forward leading channel (13) for further guidance of a choked fluid flow is arranged debouching in the area of the end of the valve body which is directed against the outside of the end wall, and the portion of the bore comprising the screw threaded portion (12) also is provided with an axially extending radial enlargement (13) at a distance from valve opening (7), said enlargement comprising a by-pass channel past the valve body and thereby the forward leading channel.

2. Device according to claim 1, wherein the sealing means (14) is arranged to cooperate with the setting means on the one hand through an element (14') which seals against flow in the flow channel and on the other hand through and element (14") comprising an outward sealing and wiping means.

3. Device according to claim 1, wherein the sealing means (14) comprises means (15) for preventing the valve element (8) from being screwed out from the bore.

4. Device according to claim 1, wherein the flow channel (6) is an end position cushioning channel.

5. Device according to claim 4, wherein the bore (11) debouches in a receiving space (4) for a cushion extension which attached to a working piston.

6. Device according to claim 5, wherein a locking ring (at 16) inside said receiving space (4) constitutes an inner stop for the valve element (8).

7. Device according to claim 1, wherein the flow channel comprises a piston speed adjustment channel.

8. Piston cylinder aggregate comprises at least two of said device according to claim 1.

9. Device in a piston cylinder aggregate including a valve element (8) which comprises a valve body (9) for choking the flow in a fluid channel (6) in cooperation with a valve opening (7), wherein the device is arranged in a bore (11) in an end wall (1) of the piston cylinder aggregate and wherein the valve element (8) is provided with a setting means (10) to allow adjustment from the outside of the end wall, wherein:

the flow channel (6) is an end position cushioning channel, the valve body (8) is provided with screw thread along its axial extension, the valve opening (7) is debouching in a portion (12) of said bore which at least partly is provided with a screw thread corresponding to the one on the valve body, the setting means (10) is extending outside the end wall surface, a ring shaped sealing means (14) is arranged in said bore (11) in direct proximity to the outside of the end wall (1) and having its outside surface substantially in level with the surrounding surface of the end wall, said sealing ring exerting a sealing cooperation with the setting means (10), the bore (11) debouches in a receiving space (4) for a cushion extension which attached to a working piston, and the valve opening (7) is located such with respect to the valve body (9) that the choking cooperation occurs at the end of the valve body which is directed against the outside of the end wall.

* * * * *